US005741548A

United States Patent [19]

Sanduja et al.

[11] Patent Number: 5,741,548

[45] Date of Patent: Apr. 21, 1998

[54] COATING COMPOSITION FOR REEMAY AND SATIN ACETATE FABRICS FOR LASER PRINTABILITY

[76] Inventors: Mohan L. Sanduja, 144-90 41 Ave., #516, Flushing, N.Y. 11355; Isabella Zilbert, 2078 Cropsey Ave., Apt. 5A, Brooklyn, N.Y. 11214; Joel A. Robinson, 226 W. 37th St., New York, N.Y. 10018; Paul Thottathil, 17 Bryant Ave., New Hyde Park, N.Y. 11040

[21] Appl. No.: 718,724

[22] Filed: Sep. 24, 1996

[51] Int. Cl.[6] ..... B05D 1/36; B05D 5/00

[52] U.S. Cl. ..... 427/261; 427/302; 427/303; 427/322; 430/31

[58] Field of Search ..... 427/302, 303, 427/322, 261; 430/31

[56] References Cited

U.S. PATENT DOCUMENTS

| | | | |
|---|---|---|---|
| 3,401,049 | 9/1968 | Horowitz | 117/47 |
| 3,698,931 | 10/1972 | Horowitz | 117/47 R |
| 3,940,377 | 2/1976 | Horowitz et al. | 260/79.5 |
| 4,737,156 | 4/1988 | Tambor et al. | 8/495 X |
| 5,156,906 | 10/1992 | Holland | 427/394 X |
| 5,232,748 | 8/1993 | Horowitz et al. | 427/553 |
| 5,407,728 | 4/1995 | Kerr et al. | 428/195 |
| 5,431,501 | 7/1995 | Hale et al. | 400/120.02 |

*Primary Examiner*—Michael Lusignan

*Attorney, Agent, or Firm*—Steinberg, Raskin & Davidson, P.C.

[57] ABSTRACT

This invention relates to a polymeric composition for application onto Reemay and Satin acetate fabric for laser printability with a high level (90% or greater readability of printed characters, washability and enzyme rejection/retardation. The polymeric composition is applied by chemical grafting that involves the use of monomers/prepolymers, catalyst, graft initiator and other ingredients of the composition. The coating thus developed and subsequently applied to Reemay and Satin acetate fabric allows to undergo graft polymerization thereby forming a polymeric film which is chemically bonded to the fabric substrate with strong adhesion. The chemically grafted fabric is highly durable and permanent in terms of distinct legibility of the printed characters on the substrate after 55 launderings or 25 dry cleanings and has excellent level or enzyme rejection/retardation when the coated fabric with laser printed characters are subjected to an enzyme wash process.

15 Claims, No Drawings

COATING COMPOSITION FOR REEMAY AND SATIN ACETATE FABRICS FOR LASER PRINTABILITY

FIELD OF THE INVENTION

This invention relates to a fabric with a polymeric coating composition layer chemically bonded thereon for laser printability of images, so that an image printed on the fabric surface has improved readability and resistance to multiple washings. This invention is also related to chemical grafting methods for placing polymer layers on a fabric surface, and to improved methods for printing a durable, high resolution image on a fabric.

BACKGROUND OF THE INVENTION

Printing methods are often used to apply monochrome or multiple color images onto fabrics used for garments and other fabric products. Images imprinted on fabrics include different patterns such as, designs, numbers, letters and symbols. Such patterns may be printed by conventional printing press techniques, as well as computer controlled inkjet, bubble jet, phase change ink-jet printing (e.g., thermal printing) and xerographic based or laser printing.

It is well known in the art that there are limitations to obtaining a durable, high resolution image on fabrics having a weave pattern that limits the fine resolution of any image applied thereto. Further, printing inks or pigments generally do not adhere to a flexible fabric through many wash cycles. Thus, it is well known in the art to apply a surface preparation material to the fabric prior to the application of the desired primed image. Hale et at., in U.S. Pat. No. 5,431,501, issued Jul. 11, 1995, teach a method for applying a surface preparation medium or binder, e.g., a polymer that may be applied by thermal printing methods to a fabric during a xerographic and/or inkjet priming process. The surface preparation medium or binder provides a layer that binds the printing inks to the fabric, and also serves to enhance the fine resolution of a printed image by reducing the roughness (from the weave pattern) of the surface to be printed on. However, such a conventional polymer coating on fabric still suffers the drawbacks inherent to previous methods, in that a number of washing or dry cleaning cycles will cause the printed image to degrade.

In one specialized use of fabric priming methods, characters and/or symbols are applied to labels to be attached to fabric products, e.g., garments. Such labels are typically printed on relatively smooth fabrics such as, e.g., Reemay (polyester) and Satin acetate fabrics. Such labels bear printed characters and/or symbols (e.g., bar codes), conveying information to the end user or to computerized scanning equipment.

Cellulose fabrics, used extensively in the fabrics industry, cannot be effectively used in conjunction with the laser printing technology. Characters printed on cellulose fabrics, using laser printing technology, are not of desirable clarity and quality to afford images suitable for bar coding registry and scanning. These laser printed characters do not endure multiple washes, dry cleaning and enzyme washes resulting in poor resolution and durability. It is important that the laser printed bar code characters have about 90% accuracy on a first read rate basis when scanned by computerized scanning equipment. This is true for the blue jeans industry which extensively uses both acid and alkaline enzyme washes during the production process. Enzyme washes are used in the blue jean industry to impart a faded look to the jeans.

In view of the above, there is a need to provide a process for printing characters using laser technology such that these characters endure multiple washings, including enzyme washes, and still provide high quality characters with desirable clarity and quality thereby providing better than about 90% accuracy when scanned by computerized scanning devices.

SUMMARY OF THE INVENTION

Generally speaking in accordance with the present invention, polymers are grafted onto substrates, such as fabrics. This grafting of polymeric material onto fabrics is achieved by chemical bonding of the polymers to the fabric substrate molecules through covalent bonding. The procedure generally involves reacting monomers having at least one acidic proton with a Graft Initiator (GI).

The acidic proton from the monomer is removed by the GI, thereby forming a monomer radical. The monomer radical then initiates the formation of polymer chains.

It is accordingly a primary object of the present invention to provide fabric material having a coating of polymeric material which is chemically bonded to the fabric.

It is a further object of the present invention to provide a method of treating a fabric surface to enhance the resolution of images imprinted thereon when scanned by a machine, such as computerized scanning devices.

Yet another object of the present invention is to provide a fabric coated with a material capable of adhering to the laser printer toner so as to assure legibility of printed characters especially after multiple washings of the fabric, i.e. the useful life of the garment.

It is yet another object of the present invention to provide laser-printed characters on fabric especially cellulose fabric of high clarity to enable bar coding registry and scanning of characters by computerized scanning devices of the bar code symbols after several washings and dry cleanings.

Other objects and advantages of the present invention will be apparent from a further reading of the specification and the claims.

This invention is applicable to any suitable fabric material, including acetate, polyester, polypropylene fabric, nylon, polyester, fiberglass, acrylic, cellulose, polyethylene, Teflon™, polyvinyl chloride, polycarbonate, and the like.

The method of the instant invention provides for a fabric having a polymer layer grafted on the fabric surface wherein images printed on the polymer layer retain about 90% machine readability after about 55 washings or about 25 dry cleanings. The washings can be conducted, e.g., with a solution comprising a laundry detergent. The resulting fabric can be cut into any suitable size or shape, including a label or a tag.

A graft initiator is used to activate the fabric surface and start the polymerization reaction. The graft initiator includes an effective concentration of a metal ion selected from $Fe^{+a}$, $Fe^{+2}$, $Ag^{+}$, $Co^{+2}$, $Cu^{+2}$ and a peroxide such as urea peroxide, benzoyl peroxide, and the like.

The invention is also related to a fabric having a grafted polymer surface thereon, with a printed image on said surface, comprising a polymer layer chemically bonded to the fabric surface. Further, the polymer surface has a printed image comprising printed characters or symbols on the surface.

The fabric according to the invention has a grafted polymer layer prepared by a process that includes treating a fabric surface with a graft initiator effective to chemically activate the fabric surface. The chemically activated surface is then contacted with a reagent that includes a polymerizable monomer or prepolymer that reacts with the activated fabric surface to form a polymer layer grafted, i.e., chemically bonded, onto the fabric surface. The polymerization reaction is then terminated by radical combination after the polymer layer is grafted to the fabric surface. The fabric to be treated includes, e.g., acetate, polyester, nylon, polyester, fiberglass, acrylic, cellulose, polyethylene, polyvinyl chloride, polycarbonate, and the like and can be in the form of a label.

Accordingly, the present invention provides a method for preparing a fabric surface for printing thereon, so that an image so printed has improved readability and resistance to multiple washings, wherein a polymer material is chemically grafted onto the fabric surface to form a polymer layer.

The method provided by the present invention for the chemical grafting of the polymer material onto the fabric surface comprises:

(a) treating a fabric surface with an effective graft initiator producing a chemically activated fabric surface;

(b) contacting the activated fabric surface with a reagent comprising a polymerizable monomer or pre-polymer to produce a polymer layer grafted fabric surface; and (c) terminating the chemical grafting by radical combination after the polymer layer is grafted onto the fabric surface.

DETAILED DESCRIPTION

Accordingly, the invention provides a method to have a polymer layer chemically bonded or grafted directly to a fabric surface. This method, where a "foreign material" becomes attached to another material by means of a chemical bond is referred to as "chemical grafting". One example is the production of acrylonitrile-butadiene-styrene (ABS) obtained by the direct grafting of styrene-acrylonitrile on a polybutadiene backbone. This often is achieved by the polymerization of styrene and acrylonitrile in the presence of butadiene.

Chemical grafting might be visualized as the growth of "whiskers" onto a material. These whiskers are joined to the basic material (which is referred to as the substrate) by means of a chemical bond. This is a much stronger bonding than that provided by ordinary chemical "coatings" where the bond between the substrate and the coating is only physical in nature.

Chemical grafting is believed to involve, as a first step, the activation of the substrate, i.e., the fabric to be treated. Once the substrate has been activated, chains of monomers linked by carbon-carbon bonds grow on the substrate resulting in the whiskers. These whiskers permanently impart new and desirable properties to the substrate without damaging any of the existing positive characteristics of the substrate.

The basic process of grafting a polymeric layer to a substrate material, including fabrics, has been the subject of patent applications by the assignee of the present invention and include, e.g., U.S. Ser. Nos., the disclosures of which are incorporated herein by reference in their entireties. This technology is applicable to liquids or solids, be they yams, fabrics, films; solutions, emulsions, etc. As a result of chemical grafting, the materials possess new and desirable properties, permanently.

In each instance, use is made of one or more of the hundreds of monomers which are commercially available at the present time. In addition, many more are readily obtainable by simple means. Typically, no new equipment or processing steps are required for carrying out the process. This method differs from many other methods of chemical grafting which require radiation, high or low pH, plasma treatment, flaming or other extremely harsh, expensive and cumbersome reaction conditions.

Where possible, the reactions of the invention make use of emulsions or aqueous solutions to minimize environmental release of organic solvents. Toward this end, methods have been developed to solubilize the necessary organic materials in water. In addition, the reactions typically exhaust the organic reactants, leaving little or no organic waste.

The grafting process thus provides a means for altering the surface chemistry of a fabric, in effect creating fabrics with useful "hybrid" properties. For example, among the "permanent" properties that can be added to a fabric are nonflammability, abrasion resistance, soil repellency, improved adhesion to fabric, ion-exchange capability, ultraviolet protection, water absorbency, gas impermeability, bactericidal, fungicidal, and the like. The areas of application of the resultant materials include textiles, plastics, pollution control, bio-material, etc.

Accordingly, the present invention provides a method for preparing a fabric surface for printing thereon, so that an image so printed has improved readability and resistance to multiple washings, wherein a polymer material is chemically grafted onto the fabric surface to form a polymer layer.

The method provided by the present invention for the chemical grafting of the polymer material onto the fabric surface comprises:

(a) treating a fabric surface with an effective graft initiator producing a chemically activated fabric surface;

(b) contacting the activated fabric surface with a reagent comprising a polymerizable monomer or pre-polymer to produce a polymer layer grafted fabric surface; and (c) terminating the chemical grafting by radical combination after the polymer layer is grafted onto the fabric surface.

The method provided by the present invention can be used on fabrics selected from a group comprising acetate, polyester, polypropylene, nylon, polyester, fiberglass, acrylic, cellulose, polyethylene, polypropylene, Teflon™, polyvinyl chloride, and polycarbonate. The fabric can be in the form of a label or a tag.

Another aspect of the present invention provides a method of printing a image on the polymer layer of a fabric surface which retains about 90–95% machine readability after about 55 washings or about 25 dry cleanings. The washings are done using a solution comprising one or more laundry grade enzymes.

Also provided by the present invention is a method for preparing a fabric surface for printing thereon wherein the monomer or pre-polymer comprises a functional moiety selected from the group consisting of hydroxyl, carboxyl, epoxy, amide, amine, anhydride, vinyl or a acrylic compound.

In yet another aspect of the present invention is provided a method wherein the graft initiator comprises an effective concentration of a peroxide compound. The peroxide compound is selected from urea peroxide and benzoyl peroxide.

In a further embodiment of a the present invention is provided a method wherein an image is printed using a xerographic or laser printing method. The image so printed comprises characters or symbols.

Polymerization Reactions

Many materials, both naturally occurring and synthetic, possess hydrogens which are more reactive than the "bulk hydrogen". Examples of reactive hydrogens are the tertiary hydrogen in polypropylene (I), the amide hydrogen in proteins (II), and the hydroxyl hydrogen in poylsaccharides (III), as shown below:

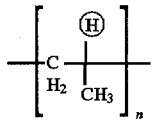

I

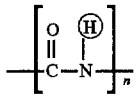

II

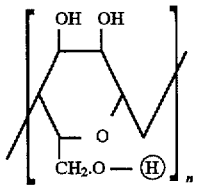

III

Graft-initiators (GI), such as Ferrous ions ($Fe^{++}$) derived from Ferrous Ammonium Sulfate, and other metal ions such as $Ag^{+}$, $Co^{++}$, $Cu^{++}$, derived from their respective salt solutions, have the capacity of removing these active hydrogens and concomitantly initiating the growth of polymer chains at the site from where the active hydrogen was removed. In the case of polypropylene, this can represented as follows:

FIG. 1

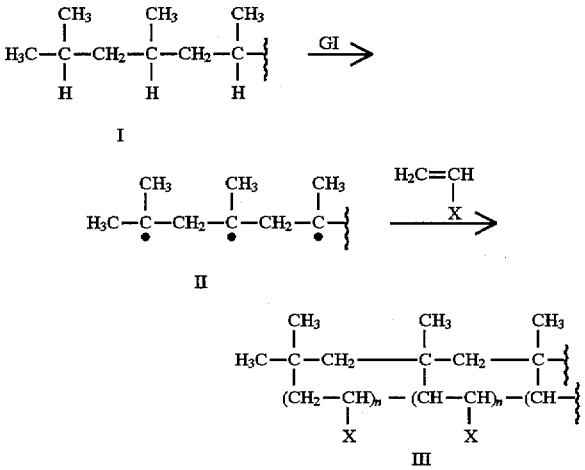

In FIG. 1, • can represent either a free radical, anion or cation, depending on whether the GI removes a hydrogen and one electron, no electrons or two electrons, respectively. There are wide variety of monomers which do not lend themselves to the free-radical type of polymerization. The fact that the methods of the present invention can use a radical, anion or cation broadens the scope of this invention. In the instant invention represents a vinyl

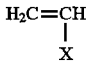

monomer unit where "X" governs the property or properties associated with the monomer. In many instances, a mixture of monomers is employed and often more than one property can be imparted to the fabric surface in one step. These polymer chains, whose length can be controlled, are permanently attached to the fabric "substrate". The linkage between the polymer and the substrate is covalent in nature. The graft polymer chains are formed from vinyl monomers or monomers containing appropriate polymerizable functionality, e.g., groups such as hydroxyl, carboxyl, epoxy, amide, amine, a hydride and so forth.

Cotton is a commonly used textile fiber which comprises from about 88% to about 96% cellulose. Cellulose is a natural carbohydrate (polysaccharide) consisting of anhydrous glucose units joined by an oxygen linkage forming essentially linear molecular chains as depicted in FIG. 2:

FIG. 2

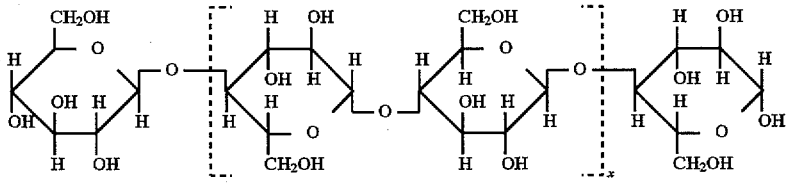

It is difficult to have long lasting dear and readable images printed on a cotton surface. Grafting a polymer layer onto the surface of a cotton fabric enhances the quality of images printed on the fabric surface.

Grafting of a cotton fabric surface with a polymeric layer can be described as a process comprising activating the cellulose molecule, attaching monomers at the reactive sites followed by chain propagation.

In particular, the process of chemically grafting a polymeric layer to a cotton fabric surface comprises abstraction of the (acidic) hydrogen atom from a hydroxy group of the cellulose molecule forming a free radical. The free radical initiates the process of chemically grafting a polymeric layer onto the fabric surface.

DETAILED DESCRIPTION OF THE PREFERRED EMBODIMENTS

The following examples illustrate various aspects of the present invention. They are not to be construed to limit the invention or the claims in any manner whatsoever.

EXAMPLE 1

METHOD OF PREPARATION OF THE FORMULATION

The method according to the invention is used to prepare a stock formulation fabric for use as printed labels. A precalculated quantity of a desired acrylic prepolymer was taken in a container and to it were added monomers, prepolymers, catalyst, graft initiator and other ingredients of the composition. Each ingredient was taken in a concentration ratio by weight as indicated in the composition shown in either Table 1, 2 or 3, below. The contents were stirred to a uniform solution.

Formulation Parameters

Total percentage (%) of solids—about 45.0% minimum;
pH—9.0 minimum;
Color—Stable at processing conditions
Formulation free of entrapped air.

Coating Line

Cure pass conditions: about 45 seconds at about 325° F.; and about 90 seconds at a maximum of about 340° F.

OC Testing

AATCC 61-1994
Accelerated Laundering: Coating integrity and print retention free from blocking, stiffness and pinholes.
Examples of Preferred Embodiments:

The following examples illustrate the invention, however, the scope of this invention is not limited to the specific details of the examples.

EXAMPLE I

| | PARTS BY WEIGHT |
|---|---|
| Acrylic prepolymer Joncryl Scx 2560 | 90.00 |
| Urethane prepolymer Resamine UMT 171 | 10.00 |
| Sodium salt of AMPS monomer | 0.20 |
| Urethane acrylate SR9035 | 0.15 |
| Sodium vinyl sulfonate | 0.05 |
| Urea peroxide (0.1% solution) | 0.01 |
| Ferrous Ammonium sulfate (0.1% solution) | 0.01 |
| Viscosity = 285–300 cps | |

EXAMPLE II

| | |
|---|---|
| Acrylic prepolymer Joncryl Scx 2560 | 90.00 |
| Urethane prepolymer Resamine UMT 171 | 10.00 |
| Polysulfonic Acid Thickner Rheothick 80-11 | 3.20 |
| Sodium salt of AMPS monomer | 0.20 |
| Urethane acrylate SR9035 | 0.15 |
| Urea peroxide (0.1% solution) | 0.01 |
| Ferrous Ammonium sulfate (0.1% solution) | 0.01 |
| Viscosity = 6,000 cps | |

EXAMPLE III

| | PARTS BY WEIGHT |
|---|---|
| Acrylic prepolymer Joncryl Scx 2560 | |
| Urethane Prepolymer Resamine UMT 171 | 40.00 |
| Polysulfonic Acid Thickening agent Rheothick 80-11 | 20.00 |
| Sodium salt of AMPS monomer | 0.80 |
| Monomer urethane acrylate SR9035 | 0.60 |
| Monomer sodium Vinyl sulfonate | 0.20 |
| Urea peroxide (0.1% solution) | 0.04 |
| Ferrous Ammonium sulfate 0.1% solution | 0.04 |
| Viscosity = 20,000 cps | |

We claim:

1. A method for improving the printability of a fabric, said method comprising the steps of:

(a) contacting a fabric surface with a graft initiator to produce a chemically activated fabric surface;

(b) contacting the activated fabric surface with a reagent comprising a polymerizable monomer or pre-polymer to produce a polymer layer grafted fabric surface; and (c) terminating the chemical grafting by radical combination after the polymer layer is grafted onto the fabric surface.

2. A method of claim 1 wherein the fabric is selected from a group consisting of acetate, polyester, polypropylene, nylon, fiberglass, acrylic, cellulose, polyethylene, polypropylene, Teflon™, polyvinyl chloride, and polycarbonate.

3. A method of claim 2 wherein the fabric is selected from a group consisting of acetate and polyester.

4. A method of claim 3 wherein the fabric is in the form of a label or a tag.

5. A method of claim 1 wherein the monomer or prepolymer comprises a functional moiety selected from the group consisting of hydroxyl, carboxyl, epoxy, amide, amine, anhydride and vinyl.

6. A method of claim 1 wherein the monomer or prepolymer comprises an acrylic compound.

7. A method of claim 1 wherein the graft initiator comprises an effective concentration of a peroxide compound.

8. A method of claim 7 wherein the peroxide compound is selected from urea peroxide and benzoyl peroxide.

9. A method of forming an image on a fabric, said method comprising the steps of:

(a) contacting a surface of said fabric with a graft initiator to produce a chemically activated fabric surface;

(b) contacting said activated fabric surface with a reagent comprising a polymerizable monomer or prepolymer to produce a polymer layer grafted onto said fabric surface; and (c) printing an image onto said polymer layer.

10. A method of claim 9 wherein said image printed on the polymer layer of said fabric surface retains about 95% machine readability after about 55 washings or about 25 dry cleanings.

11. A method of claim 10 wherein the washings are done using a solution comprising one or more laundry grade enzymes.

12. The method of claim 9 wherein said step of printing comprises xerographic printing.

13. The method of claim 9 wherein said step of printing comprises laser printing.

14. The method of claim 9 wherein said image is a bar code.

15. The method of claim 9, said method further comprising terminating said grafting of said polymer layer onto said fabric surface by radical combination.

* * * * *